US005333778A

United States Patent [19]

Specker

[11] Patent Number: 5,333,778

[45] Date of Patent: Aug. 2, 1994

[54] PACKAGING WITH INTEGRATED PARTITIONING

[75] Inventor: Erich Specker, Altstätten, Switzerland

[73] Assignee: Dividella AG, Grabs, Switzerland

[21] Appl. No.: 18,199

[22] Filed: Feb. 16, 1993

[30] Foreign Application Priority Data

Mar. 16, 1992 [CH] Switzerland ..... 820/92-4
Sep. 7, 1992 [CH] Switzerland ..... 2793/92/4

[51] Int. Cl.[5] ..... B65D 25/04
[52] U.S. Cl. ..... 229/120.24
[58] Field of Search ..... 229/120.06, 120.24, 229/120.25, 120.26, 120.27, 120.28

[56] References Cited

U.S. PATENT DOCUMENTS

| | | | |
|---|---|---|---|
| 1,770,701 | 7/1930 | Kelly | 229/120.24 |
| 2,717,073 | 9/1955 | Young | 229/120.24 |
| 4,376,507 | 3/1983 | Nauheimer | 229/120.24 |

FOREIGN PATENT DOCUMENTS

| | | | |
|---|---|---|---|
| 1077186 | 11/1954 | France | 229/120.24 |
| 565374 | 7/1957 | Italy | 229/120.24 |
| 243245 | 12/1946 | Switzerland | 229/120.24 |
| 340762 | 10/1959 | Switzerland | 229/120.24 |
| 386922 | 4/1965 | Switzerland | 229/120.24 |

*Primary Examiner*—William I. Price
*Attorney, Agent, or Firm*—Shoemaker and Mattare, Ltd.

[57] ABSTRACT

The support blank (1) forms the actual packaging envelope with the parallel side walls (4, 4'), which run parallel to the corrugations (3). These corrugations are formed from a shaped blank (2) which is connected with the support blank at the corrugation valleys. An end corrugation (6, 6') is in each case arranged directly next to the parallel side walls (4, 4'), the outer wall (7) of which is no longer connected with the support blank. The outer wall lies loosely against the parallel side wall and through that is held in position.

16 Claims, 9 Drawing Sheets

Figure 1:
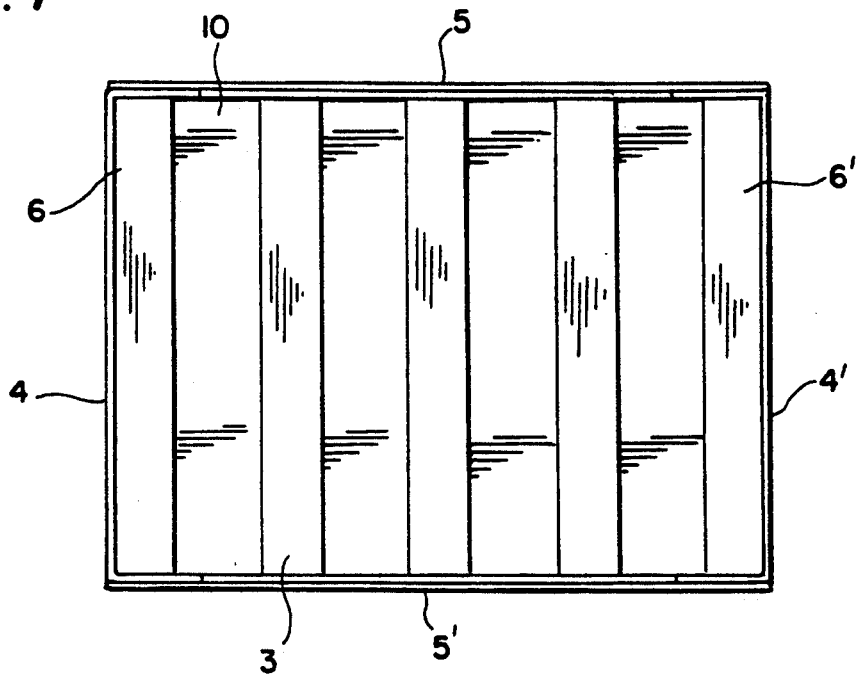

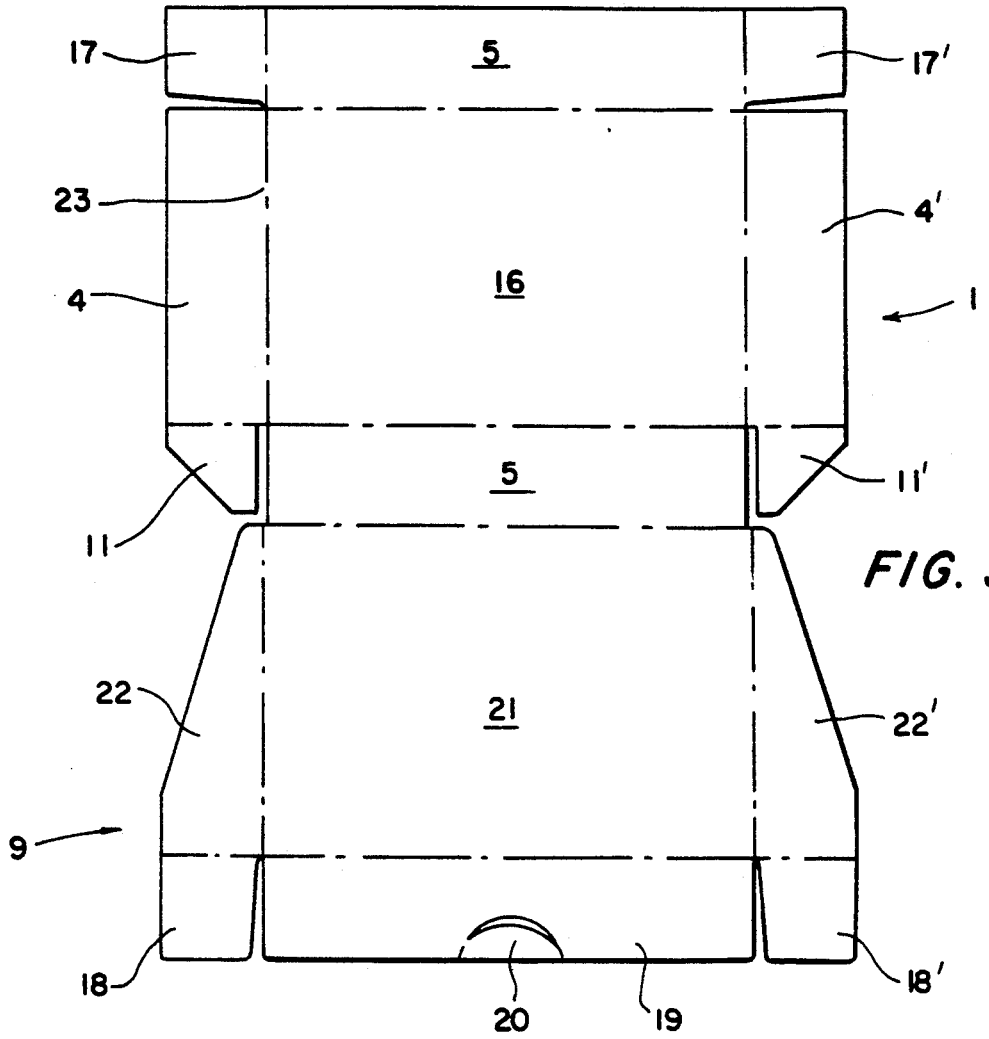
FIG. 5
FIG. 6
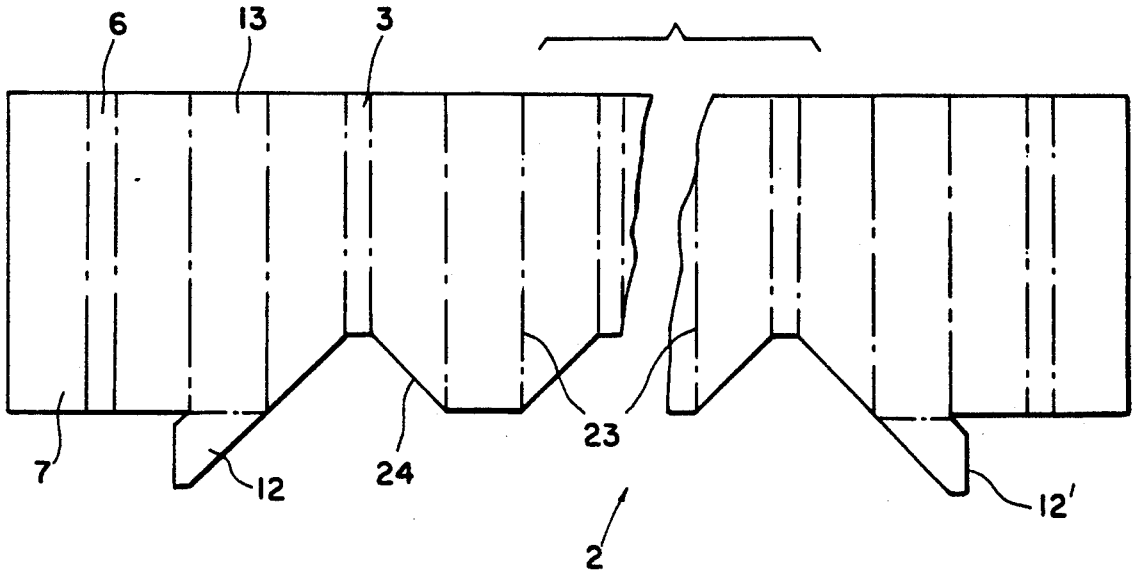

PACKAGING WITH INTEGRATED PARTITIONING

The invention concerns packaging for the acceptance of longitudinal objects. These types of packaging serve to accept ampules, bottles and similar fragile items.

One problem exists with similar, related packaging in each case during formation of the final corrugation on both sides of the packaging. If the final corrugation is dispensed with, so that the final individual compartment is formed by a part corrugation and by a parallel side wall, this final individual compartment remains relatively unprotected against knocks and shocks. For this reason, damage to the items inserted into these outer individual compartments occurs frequently. If, however, the outer individual compartment is also closed off with a complete corrugation, the adhesion of this corrugation to the support blank will require an additional, horizontal material strip which protrudes to the side, glued to an extended support blank. This widens the packaging.

It is therefore a purpose of the invention to create packaging of the type described in the introduction, with which also the outer individual compartments are bordered and protected by a full corrugation, the packaging being able to be manufactured with the minimum use of material. According to the invention, this purpose is fulfilled with packaging as described below.

The construction, in accordance with the invention, enables the provision of a complete end corrugation on both sides, without the need also for glueing the outer wall of these end corrugations. The end corrugations are indeed completely shaped, however they are merely held in position by the parallel side walls. Since the parallel side walls are integrated into the support blank, an additional material blank can also be dispensed with. The corrugations are glued directly onto the box base.

Preferably, the support blank also forms at least one transverse side wall for the packaging, running transverse to the corrugations, which is connected to the parallel side walls. The support blank thus evidently has two functions. On the one hand, it forms the actual packaging envelope, and on the other hand serves the purpose of holding the corrugations firmly in their predetermined position.

The packaging can be closeable with a separate slip lid. It can, however, also be closeable with a folding lid which is integrally formed with the support blank. Shrink foils, paper bands etc. would also be conceivable.

Particularly user friendly packaging arises if the folding lid is hinged on a transverse side wall which is not directly connected with the parallel side walls and which is able to be pivoted out together with the folding lid. In this way the front of the packaging can be fully uncovered, which considerably facilitates the removal of items lying within. In order to also avoid contamination of the interior of the packaging, with this version as well, the end corrugations and the individual compartments immediately bordering on these can be protected by dust tabs which are formed integrally with the parallel side walls. These dust tabs form a tight closure in the corner areas. In order to avoid the dust tabs pivoting outwards when the packaging is opened, it is of particular advantage if these are connected to support tabs which are formed integrally with the shaped blank and which can be folded out from the plane of a corrugation valley. In this way, the dust tabs can be rigidly glued, in spite of the transverse side wall being able to be pivoted out.

The corrugations can also, in a known way, possess differing cross sections. With that, they can be formed approximately prismatically, for example rectangularly. The cross section of the corrugations can remain the same throughout their entire length, or the corrugations can possess portions with differing cross sections. This configuration is particularly suited for the accommodation of items with varying cross section throughout their longitudinal axis, or for the accommodation of differently shaped items within the same packaging.

Tamper indication on a version of the packaging with a folding lid can be achieved in a particularly simple way if the folding lid possesses an insert strip which is able to be inserted between the faces of the corrugations and a transverse side wall, and if a press-in tongue, which is bordered by a perforation and which is connected to the insert strip, is arranged on the transverse side wall, the press-in tongue being able to be pressed in during initial opening of the packaging and remain on the insert strip. The connection between insert strip and press-in tongue ensues during initial closure of the filled packaging. Opening of the folding lid is obviously not possible without depression of the perforation. This tamper indicating closure also permits particularly easy manufacture on automatic filling plants.

With that, the insert strip can likewise possess a press-in tongue which corresponds to the equivalent on the transverse side wall, both the press-in tongues being firmly connected with each other and being able to be pressed in together when opening for the first time. The corrugations lying in the area of the press-in tongues can, with that, possess a recess providing space for release of the press-in tongues. The faces of the corrugations obviously provide support for the transverse side wall, with the exception of that point which should be pressed in.

A particularly advantageous tamper indicating packaging can be achieved if opening tabs, which are able to be torn open for the removal of items, are arranged in the transverse side wall on the face of each individual compartment. In this way, each individual item can be fully enclosed by the packaging, the individual removal of items being possible at the face. An initial opening of a compartment is, with that, displayed by tearing open of the opening tabs. The end corrugations also make possible here an optimum utilisation of the basic area. This embodiment of the packaging is particularly suitable for the packaging of sterile disposal syringes.

The packaging can, with that, be closed with a firmly glued folding lid which is integrally formed with the support blank and which possesses a window tab which is able to be torn open for the formation of a viewing port. The packaging contents can in this way be checked, without the possibility of removal of the individual items through the viewing port.

If the tearable opening tabs run to a point towards the upper side edge of the transverse side wall, the opening tabs can be relatively easily pressed out, respectively grasped hold of.

Figure 2:
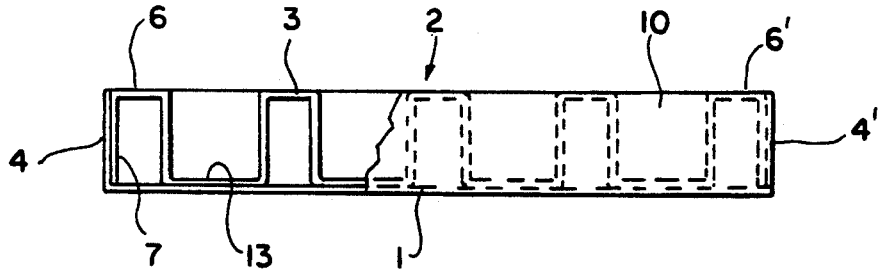
Figure 3:
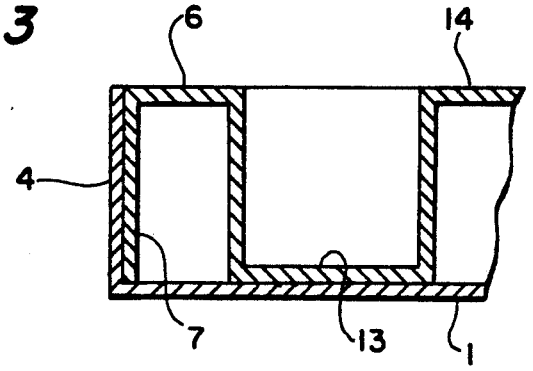
Figure 4:
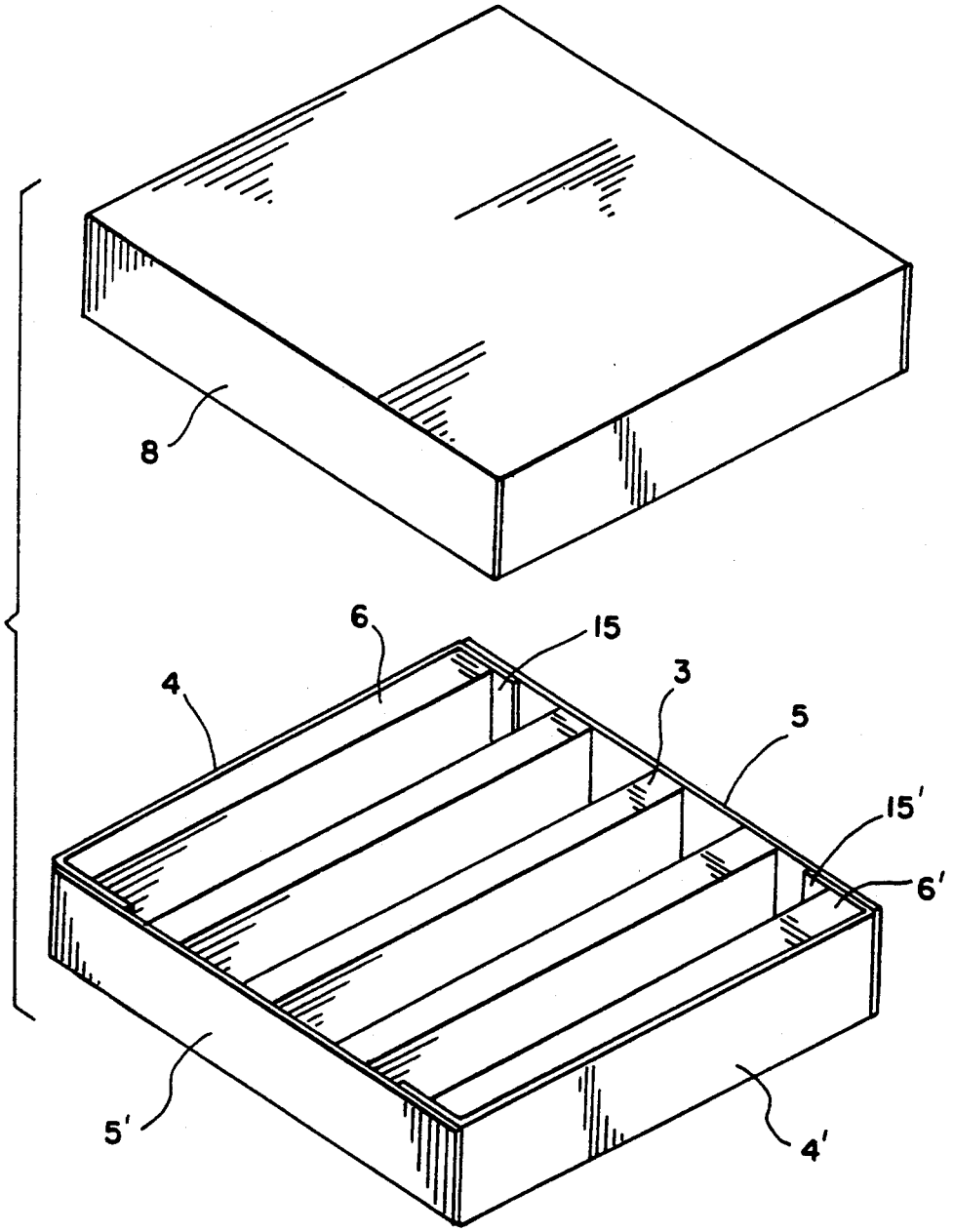
Figure 7:
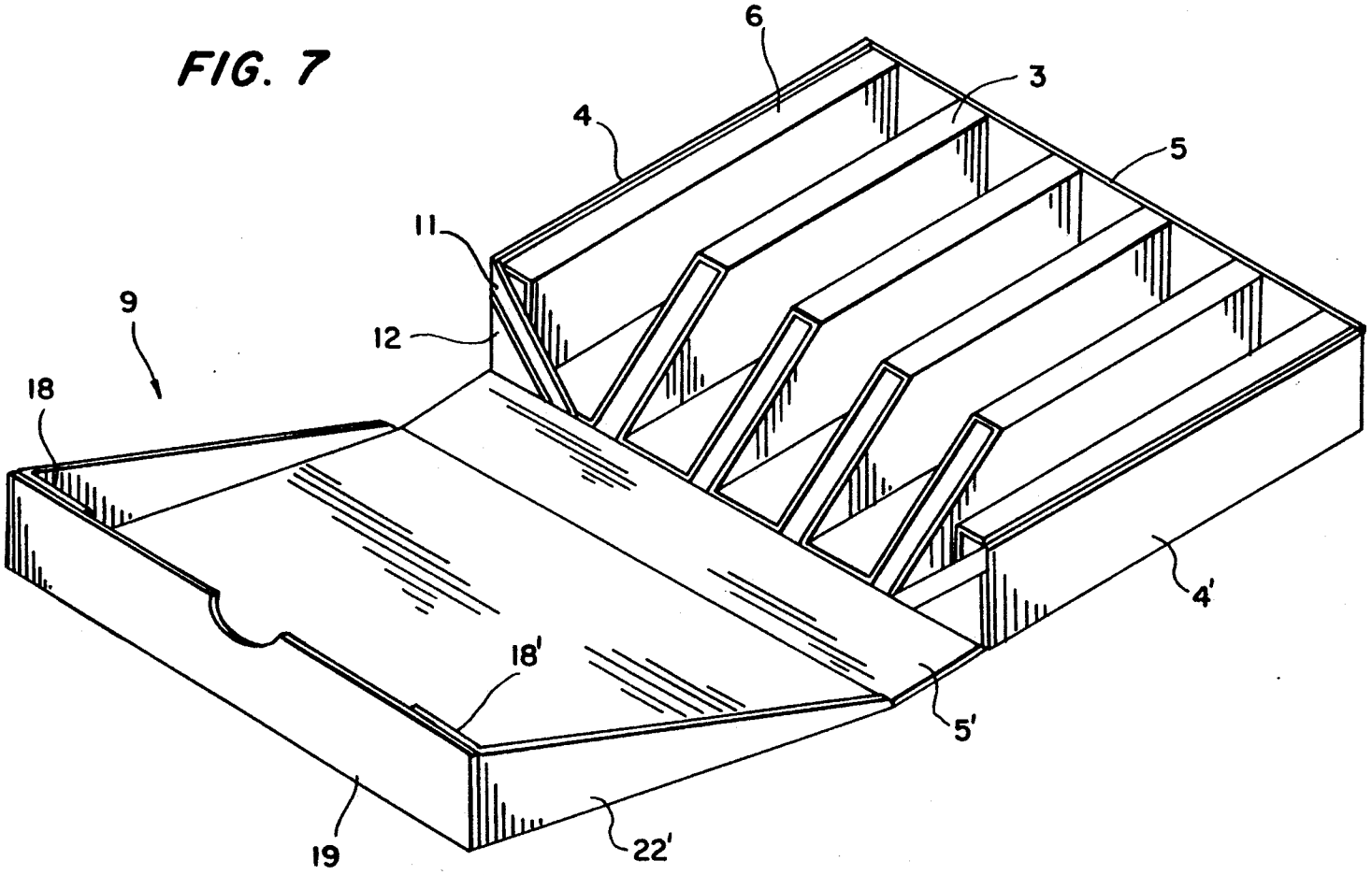
Figure 8:
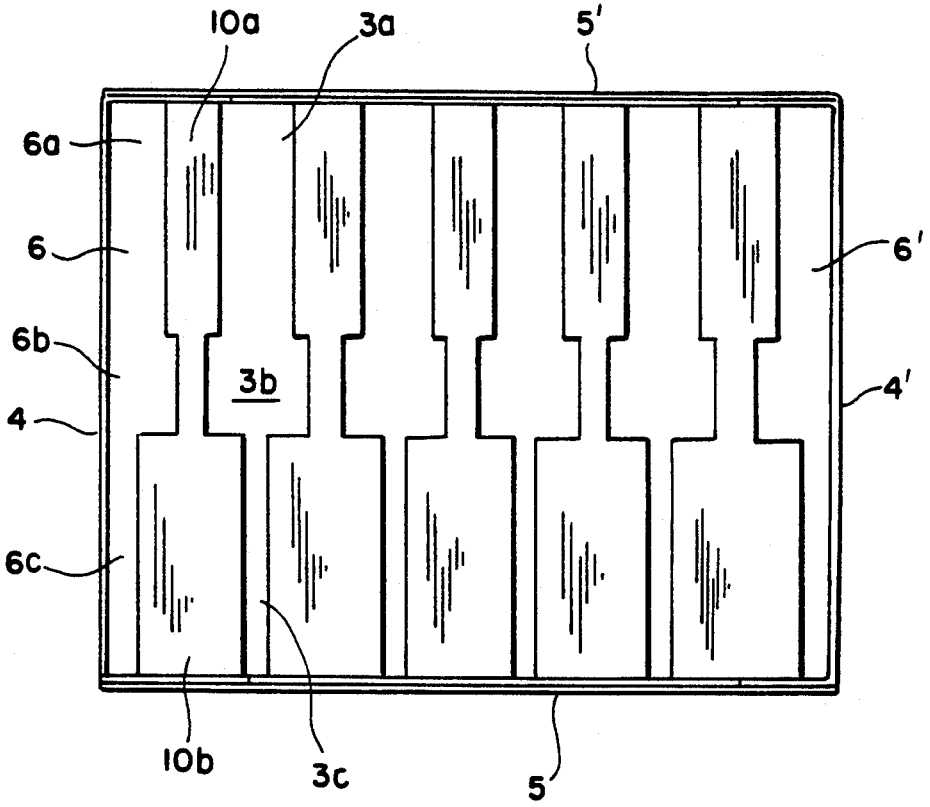
Figure 9:
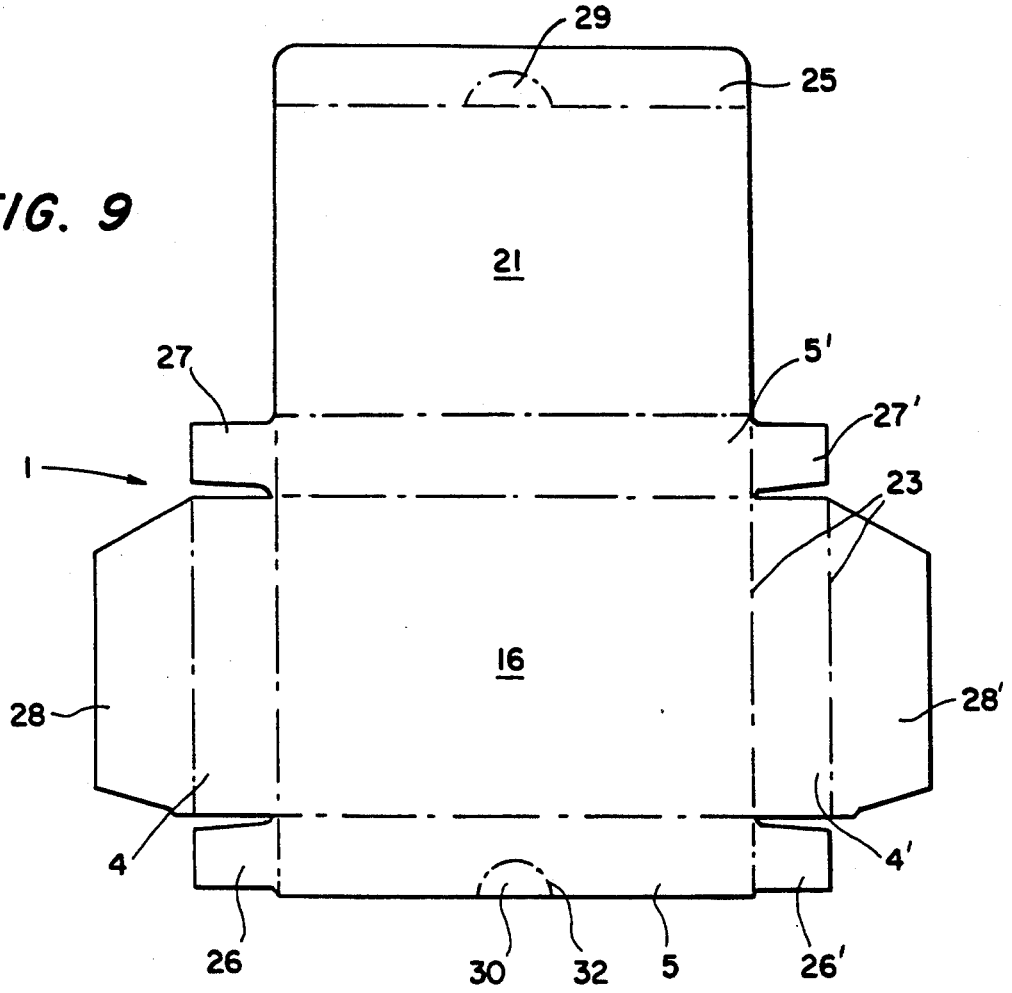
Figure 10:
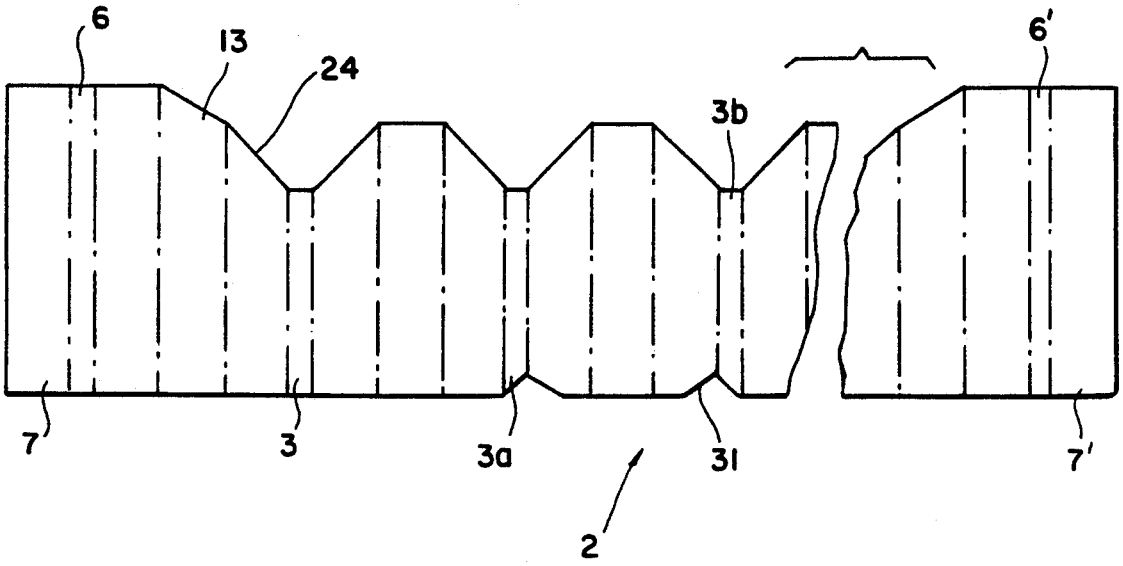
Figure 11:
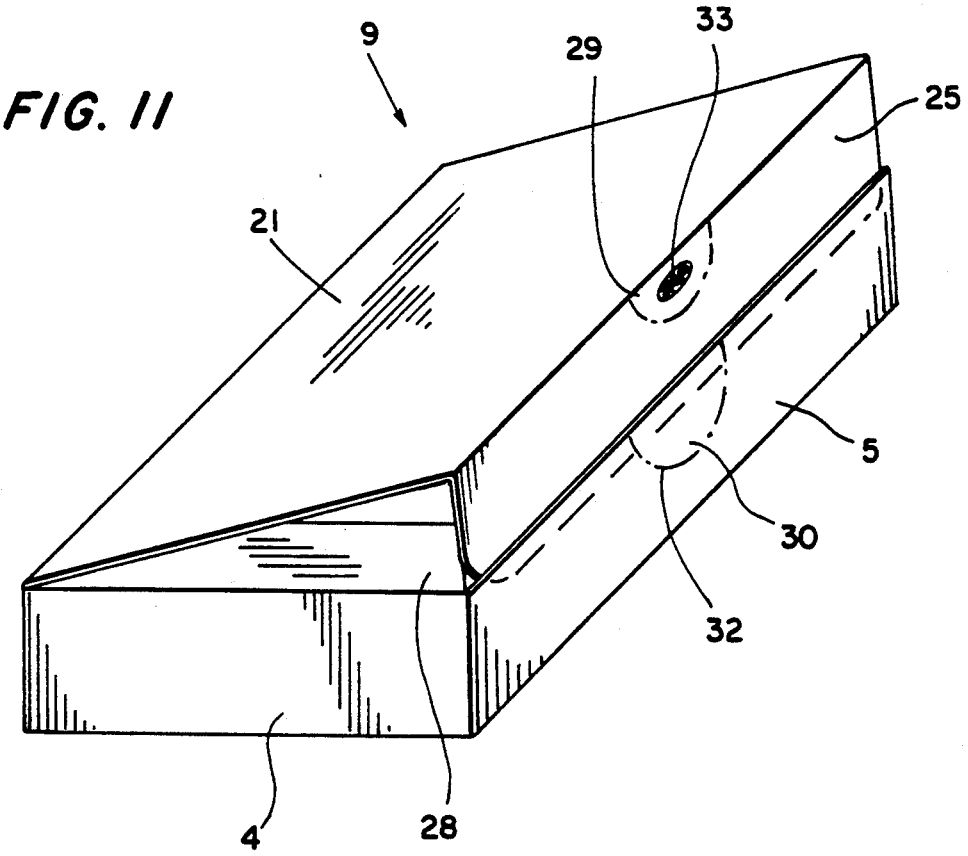
Figure 12:
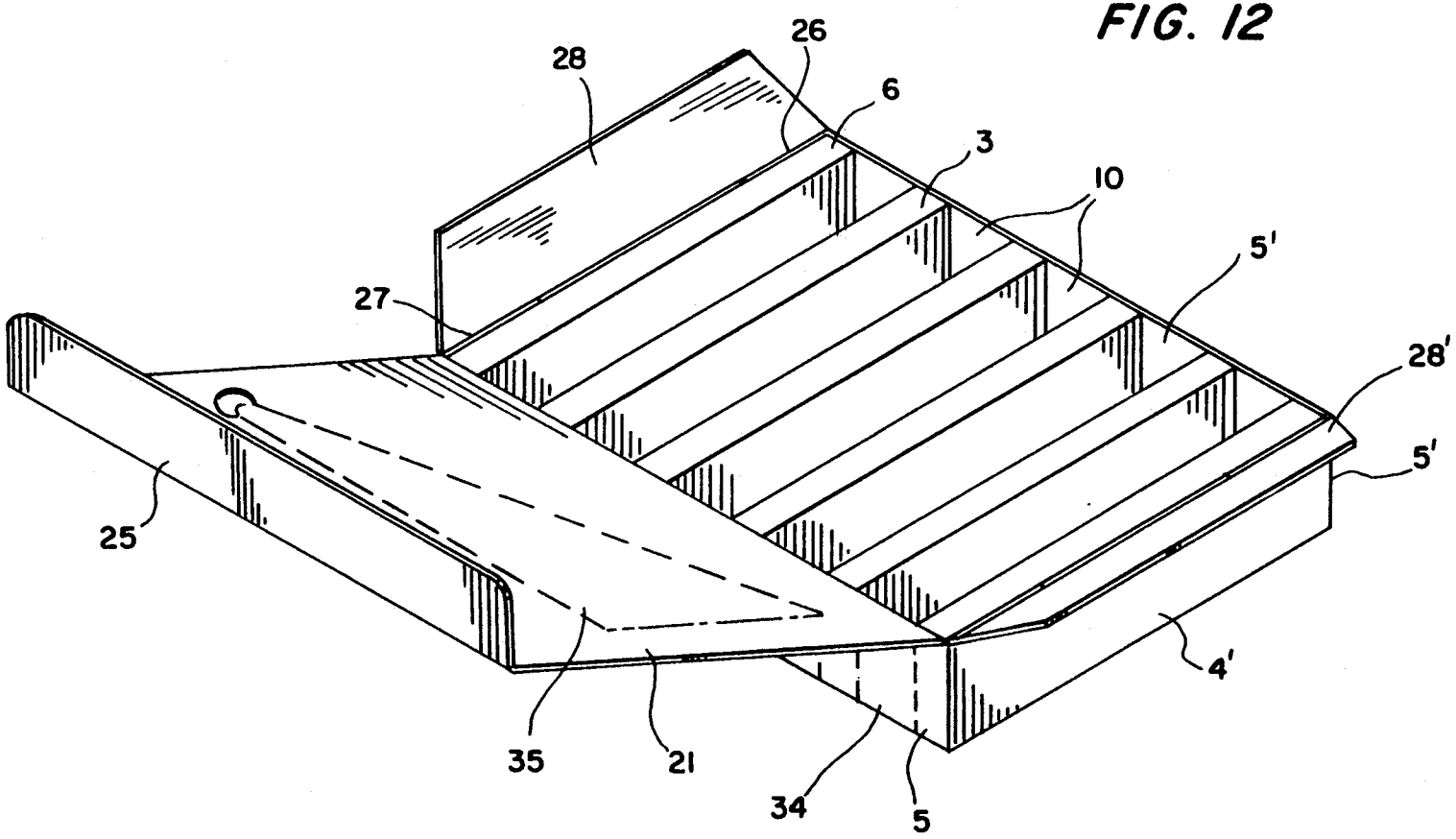
Figure 13:
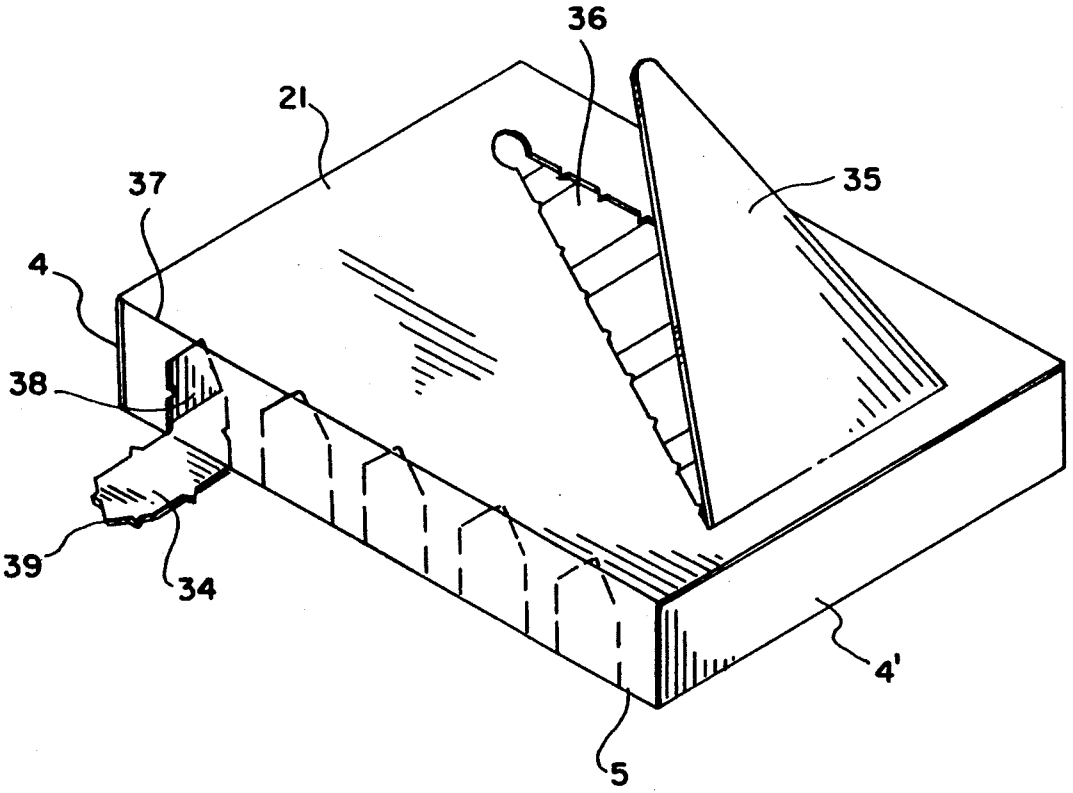

Examples and embodiments of the invention are more closely described in the following, illustrated by the drawings. Namely:

FIG. 1 a plan view of packaging according to the invention,

FIG. 2 a partial cross section through the packaging according to FIG. 1,

FIG. 3 an enlarged detail of the representation according to FIG. 2,

FIG. 4 a perspective representation of the packaging according to FIG. 1 with slip lid, FIG. 5 a support blank of an alternative embodiment of the packaging, FIG. 6 a shaped blank for the support blank according to FIG. 5, FIG. 7 a perspective representation of the finished packaging made from the blanks according to FIGS. 5 and 6, FIG. 8 a plan view of a further embodiment with differently shaped corrugations, FIG. 9 a support blank of a further embodiment of the packaging, FIG. 10 a shaped blank for the support blank according to FIG. 9, FIG. 11 a perspective representation of the finished packaging made from the blanks according to FIGS. 9 and 10, FIG. 12 a perspective representation of a further embodiment with removal openings at the face, before closure of the packaging, and FIG. 13 the packaging according to FIG. 12 with closed lid and with an opened removal opening.

The FIGS. 1 to 4 show an embodiment of the packaging with a separate slip lid 8, which is in principle assembled in a known way. A support blank 1 is glued to a shaped blank 2 which is deformed to be corrugated. The parallel side walls 4, 4' and the tranverse side walls 5, 5' are shaped integrally from the support blank 1 and folded over from the plane of the base through 90 degrees. Side tabs 15, 15, which are glued to the transverse side walls 5, 5',' are arranged on the parallel side walls 4, 4'. Naturally, these side tabs could also be arranged on the transverse side walls.

The individual corrugations 3 form individual compartments 10 between one other, for introduction of the contents of the packaging. The connection between the support blank 1 and the shaped blank 2 occurs, with that, exclusively at the valleys of the corrugations 13. An end corrugation 6, 6' is in each case arranged directly next to the parallel side walls 4, 4'. As can be seen particularly in FIG. 3, the outer wall 7 of such a end corrugation makes close contact with the parallel side wall 4. A firm connection of this outer wall with the support blank 1 is not provided, and also not required. Through that, no disruptive cavity occurs between the end corrugation and the parallel side wall, as would be necessary when glueing the outer wall 7 to the support blank by means of a protruding, horizontal material strip.

FIGS. 5 to 7 show an embodiment with a folding lid 9 which is connected integrally with the support blank 1. The configuration of this support blank can be seen in FIG. 5. The support blank has a base 16, on the edges of which, once again, the parallel side walls 4, 4' and the transverse side walls 5, 5' connect. Side tabs 17 and 17' are arranged on both sides of the transverse side wall 5. The parallel side walls 4, 4' are integrally connected with the approximately triangular dust tabs 11, 11'. The lid 21, with a facing strip 19 and with the side strips 22, 22', is directly connected to the transverse side wall 5. Side tabs 18, 18' are arranged on the side strips 22, 22'. A tamper indicating tongue 20 is die cut into the facing strip 19, which can be ruptured in order to open the lid. All individual sections are separated from one another by folded edges 23 in a known way.

FIG. 6 shows a shaped blank 2 in its extended position, however somewhat shortened. The individual sections are likewise separated from each other by folded edges 23. The end corrugations 6, 6' extend over the entire width of the packaging, whilst the other corrugations 3 are provided with an inclination 24. Support tabs 12, 12' are shaped onto the outermost corrugation valleys 13, 13'. The shaped blank is closed off at the outside by both the outer walls 7, 7'.

FIG. 7 shows the packaging, completely glued from the material sections according to FIGS. 5 and 6. On the folding lid 9, the side tabs 18, 18' are glued to the facing strip 19. The tamper indicating tongue 20, which is glued to the transverse side wall 5 during initial closure, has been ruptured.

Whilst the transverse side wall 5 remains in its upright position through glueing of the side tabs 17, 17' with the parallel side walls 4, 4', the transverse side wall 5' can be completely pivoted out together with the folding lid 9. The face becomes particularly easily accessible by this means. The inclinations 24 on the corrugations 3 further facilitate this accessibility. Since the transverse side wall 5' is not connected with the parallel side walls 4, 4' to form a seal, sealing of the corner area is effected by means of the dust tabs 11, 11'. These are folded over from the plane of the erected parallel side walls 4, 4' and connected with the likewise erected support tabs 12, 12'. By this means, the dust tabs remain in a rigid position, also when the transverse side wall 5' is displaced.

FIG. 8 shows an alternative embodiment of the packaging, not only the end corrugations 6, 6' but also the corrugations 3 possessing differing cross sectional shapes. The end corrugations have the sections 6*a*, 6*b*, 6*c* and the corrugations have the sections 3*a*, 3*b*, 3*c*. From this, individual compartments 10*a*, 10*b* of individual configuration will arise. The individual sections of differing cross sectional shape are formed by means of incisions which run parallel to the transverse side walls 5, 5'.

FIGS. 9 to 11 show a further embodiment of the packaging with folding lid and with a particularly advantageous tamper indicating closure. The support blank 1 and the shaped blank 2 are, with that, designed somewhat differently to the blanks according to FIGS. 5 and 6. On the base 16, the parallel side walls 4, 4' and the transverse side walls 5, 5' once again connect to the sides. Both these transverse side walls are both provided, at their sides, with the side tabs 26, 26' and 27, 27', which are glued to the parallel side walls 4, 4' on assembly. As opposed to the embodiment according to FIG. 5, the transverse side wall 5' can not be folded out. The lid 21 is hinged to the transverse side wall 5', which is provided with an insert strip 25 on its free, guided side. Dust tabs 28, 28' are provided for lateral sealing of the lid.

A press-in tongue 30 is formed on the transverse side wall 5 by means of a half-moon shaped perforation 32. In a similar way, a press-in tongue 29, which approximately corresponds to the press-in tab 30 in shape and position, is also arranged on the insert strip 25.

The shaped blank 2 according to FIG. 10 is shaped similarly to that according to FIG. 6. The support tabs are, of course, missing. As opposed to that, inclinations 24 are likewise anticipated, indeed exclusively with the corrugations 3 which lie between the end corrugations 6 and 6'. Those corrugations 3*a* and 3*b*, which lie in the area of the press-in tongues 29, respectively 30 on the support blank, are provided with a recess 31.

The completely assembled packaging is represented in figure 11, indeed shortly before initial closure of the filled packaging. Here, a hotmelt 33 is applied to the press-in tongue 29 on the insert strip 25, before the insert strip is inserted between the transverse wall 5 and the face of the corrugations. The hotmelt provides, with that, a firm connection between the press-in tongue 29 and the inner side of the press-in tongue 30. The corrugations 3*a* and 3*b* (FIG. 10), with the recesses 31, lie, in the case of closed packaging, approximately just within the pivoting area of the two interconnected press-in tongues 29 and 30.

For initial opening of the packaging, finger pressure is exerted onto the press-in tongue 30, until the perforation 32 breaks and both the tongues 29 and 30 pivot inwards. Now the entire folding lid 9 can be lifted without effort and the packaging subsequently permits further closure through reinsertion of the insert strip 25.

A tamper indicating closure can also be realised in exactly the same way on the packaging according to FIG. 7. There, however, the facing strip 19 lies, with the press-in tongue, outside on the transverse side wall 5.

The shapes for the press-in tab can be fully varied, and thus, for example, also rectangular or trapezoidal.

In FIGS. 12 and 13, a further embodiment of the packaging is represented, with which removal of the contents does not ensue from above but from the face. As with the previously described packaging, all components are manufactured from a support blank and a shaped blank. Dust tabs 28, 28' are arranged on the parallel side walls 4, 4'. The side tabs 26 and 27 on the transverse side walls 5, 5' run parallel to the corrugations 3 and 6. A folding lid 21 with an insert strip 25 is hinged onto the transverse side wall 5. During closure of the packaging, this folding lid is firmly glued to the insert strip and to the dust tabs 28 and 28', so that opening is only possible through destruction of the packaging.

At the face of each individual compartment 10, an opening tab 34 is bordered by a perforation on the transverse side wall 5. As can be seen particularly in FIG. 13, these opening tabs run to a tip towards the upper edge 37 of the transverse side wall 5, the outermost tip even reaching into the area of the lid 21. In the lid 21 itself a window tab 35 is likewise bordered by perforations.

In this packaging, for example sterile disposable syringes can be packed. The sterility of these types of syringes is only ensured as long as they are not handled in any way. In the case of packaging which exposes the entire contents when the lid is opened, there exists no guarantee that the entire packaging contents have remained untouched since initial opening of the packaging. In the case of the embodiment in question, for removal of an item lying within one individual compartment 10, the corresponding opening tab 34 must be torn open. The tips 39 of these tabs protrude slightly above the upper edge 37 of the transverse side wall 5, and can be relatively easily grasped hold of. By means of the opening 38 occurring in this way, the item can be removed. Evidentally, in this way it will be ensured that the items in the still closed individual compartments have remained untouched since filling.

In order to check whether the packaging in fact actually contains the correct contents, the window tab 35 can be torn open and folded back, so that a viewing port 36 is formed which does not fully reveal the individual compartments 10. The items, thus for example the disposable syringes, can be merely observed through the viewing port 36, but not removed. Naturally, the window tab 35 could also possess another configuration than the triangular one shown here. The end corrugations 6 ensure here, too, good lateral protection of the outermost individual compartments 10. In spite of this, the basic area of the packaging is optimally exploited and the intermediate space between the outermost openings 38 and the parallel side walls 4, respectively 4', is not larger than the intermediate space between the individual openings 38.

Inasmuch as the invention is subject to modifications and variations, the foregoing description and accompanying drawings should not be regarded as limiting the invention, which is defined by the following claims and various combinations thereof:

I claim:

1. A package for accommodating elongate items, said package comprising a support blank (1) having a bottom wall, a pair of parallel side walls (4, 4'), and at least one transverse wall (5') connected to the side walls, a shaped blank (2) glued to the bottom wall of the support blank, said shaped blank having parallel corrugations (3), with rectangular cross-sections, extending parallel to the side walls and to the bottom wall, and including outermost full corrugations (6, 6') having respective outer walls (7, 7') which bear against the side walls of the support blank, but are not connected to the support blank.

2. A package according to claim 1, further comprising a separate lid (8) which can be slipped over the package to close it.

3. A package according to claim 1, further comprising a folding lid (9) for closing the package, said folding lid being formed integrally with the support blank.

4. A package according to claim 3, wherein the package has a transverse wall (5) hinged to said bottom wall but unconnected to its side walls, and the folding lid (9) is hinged to said unconnected transverse wall.

5. A package according to claim 4, further comprising dust tabs (11, 11') which are formed integrally with the parallel side walls, for protecting at least one end face of the outermost corrugations and their adjacent individual compartments.

6. A package according to claim 5, wherein the corrugations form crests (14) and valleys (13), and the dust tabs (11, 11') are connected to support tabs (12, 12') which are formed integrally with the shaped blank and are folded out from respective ones of said corrugation valleys.

7. A package according to claim 6, wherein the corrugations (3, 6) are prismatic.

8. A package according to claim 7, wherein each corrugation has a cross-section which is uniform lengthwise.

9. A package according to claim 8, wherein the corrugations have cross-sections which are not identical with one another.

10. A package according to claim 3, wherein the folding lid (9) has an insert strip (25) which can be inserted between ends of the corrugations and an adjacent transverse wall (5), and further comprising a press-in tongue (30) bordered by a perforation (32) and connected with the insert strip (25), arranged on the transverse wall, said tongue being capable of being pressed in when opening the package initially, and thereafter remaining on the insert strip (25).

11. A package according to claim 10, wherein the press-in strip has a press-in tongue (29) which corresponds to that on the transverse wall (5), both said press-in tongues (29,30) being firmly connected to one another and being capable of being pressed in when opening the package initially.

12. A package according to claim 11, wherein the corrugations (3*a*, 3*b*) lying in the area of the press-in tongues (29, 30) have a recess (31) for the release of the press-in tongues.

13. A package according to claim 3, wherein the folding lid (9) has both a facing strip (19) which can be slid over one said transverse wall (5) and a press-in tongue (20), bordered by a performation and connected with the transverse wall, arranged on the facing strip, the press-in tongue being capable of being pressed in when opening the package initially, and thereafter remaining on the insert strip.

14. A package according to claim 1, further comprising opening tabs (34), arranged in the transverse wall (5) on the face of each individual compartment (10), which can be torn open in order to remove items from the compartments.

15. A package according to claim 14, wherein the package is closed by means of a firmly glued lid which is integrally formed with the support blank and which possesses a window tab (35) which is able to be torn open for forming a viewing port (36).

16. A package according claim 14 or claim 15, wherein said opening tabs (34) have tapered tips adjacent the upper side edge (37) of the transverse wall (5).

* * * * *